US008979505B2

(12) United States Patent
Pessin et al.

(10) Patent No.: US 8,979,505 B2
(45) Date of Patent: Mar. 17, 2015

(54) SENSOR SYSTEM FOR A POSITIVE DISPLACEMENT PUMP

(75) Inventors: Jean-Louis Pessin, Houston, TX (US); Joe Hubenschmidt, Sugar Land, TX (US); Erik Rhein-Knudsen, La Baule (FR); Toshimichi Wago, Houston, TX (US); Nathan St. Michel, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/550,202

(22) Filed: Oct. 17, 2006

(65) Prior Publication Data

US 2007/0139211 A1 Jun. 21, 2007

Related U.S. Application Data

(63) Continuation-in-part of application No. 11/312,124, filed on Dec. 20, 2005.

(51) Int. Cl.

| | |
|---|---|
| ***F04B 49/00*** | (2006.01) |
| ***F04B 47/00*** | (2006.01) |
| ***E21B 47/00*** | (2012.01) |
| ***F04B 9/00*** | (2006.01) |
| ***F04B 49/22*** | (2006.01) |
| ***F04B 51/00*** | (2006.01) |

(52) U.S. Cl.

CPC ..... *F04B 47/00* (2013.01); *E21B 47/0008* (2013.01); *F04B 9/00* (2013.01); *F04B 49/22* (2013.01); *F04B 51/00* (2013.01); *F04B 2201/0201* (2013.01); *F04B 2201/0603* (2013.01)

USPC ..... 417/63; 251/359

(58) Field of Classification Search

USPC ..... 417/63, 53, 412, 490, 492, 535, 568, 417/569; 251/332, 357; 137/554, 551; 73/587; 702/182, 188

See application file for complete search history.

(56) References Cited

U.S. PATENT DOCUMENTS

| | | | | | |
|---|---|---|---|---|---|
| 4,456,963 | A | * | 6/1984 | Wiggins | 701/102 |
| 4,655,077 | A | * | 4/1987 | Purvis et al. | 73/86 |
| 4,705,459 | A | | 11/1987 | Buisiine et al. | |
| 4,866,607 | A | * | 9/1989 | Anderson et al. | 702/11 |

(Continued)

FOREIGN PATENT DOCUMENTS

| | | | |
|---|---|---|---|
| GB | 2104958 | A * | 3/1983 |
| SU | 478208 | A * | 10/1975 |
| WO | WO91/08445 | | 6/1991 |

OTHER PUBLICATIONS

SU 478208 A abstarct,Oct. 1975,RU,Trade Equip.*

*Primary Examiner* — Devon Kramer
*Assistant Examiner* — Amene Bayou
(74) *Attorney, Agent, or Firm* — Jeffrey R. Anderson; Rachel E. Greene; Tim Curington

(57) ABSTRACT

A positive displacement pump is provided that includes a pump housing having a pump chamber; a plunger mounted in the pump housing for reciprocating motion in the pump chamber; a suction valve positioned to allow a fluid to enter the pump chamber upon movement of the plunger in a first direction; a discharge valve positioned to discharge the fluid from the pump chamber upon movement of the plunger in a second direction; and at least one sensor enclosed by the pump housing for measuring at least one pump condition parameter.

13 Claims, 3 Drawing Sheets

(56) References Cited

U.S. PATENT DOCUMENTS

| | | | | |
|---|---|---|---|---|
| 5,431,186 | A * | 7/1995 | Blume | 137/516.29 |
| 5,540,448 | A * | 7/1996 | Heinzen | 277/321 |
| 5,720,598 | A | 2/1998 | de Chizzelle | |
| 5,846,056 | A * | 12/1998 | Dhindsa et al. | 417/44.2 |
| 6,003,872 | A * | 12/1999 | Nord | 277/317 |
| 6,131,609 | A * | 10/2000 | Metso et al. | 137/552 |
| 6,260,004 | B1 * | 7/2001 | Hays et al. | 702/183 |
| 6,292,757 | B1 * | 9/2001 | Flanagan et al. | 702/138 |
| 6,588,313 | B2 * | 7/2003 | Brown et al. | 92/5 R |
| 6,742,994 | B2 * | 6/2004 | Hironaka et al. | 417/63 |
| 6,945,098 | B2 * | 9/2005 | Olson | 73/86 |
| 6,970,793 | B2 | 11/2005 | Pearson et al. | |
| 7,013,223 | B1 * | 3/2006 | Zhang et al. | 702/34 |
| 7,112,892 | B2 * | 9/2006 | Mahowald | 290/54 |
| 2004/0213677 | A1 * | 10/2004 | Matzner et al. | 417/63 |
| 2006/0054329 | A1 * | 3/2006 | Chisholm | 166/372 |
| 2006/0078435 | A1 * | 4/2006 | Burza | 417/279 |
| 2006/0228225 | A1 * | 10/2006 | Rogers | 417/63 |

* cited by examiner

SENSOR SYSTEM FOR A POSITIVE DISPLACEMENT PUMP

CROSS REFERENCE TO RELATED APPLICATIONS

This application claims priority to and is a Continuation-In-Part of U.S. patent application Ser. No. 11/312,124, filed on Dec. 20, 2005, which is incorporated herein by reference.

FIELD OF THE INVENTION

The present invention relates generally to a sensor system for use in a positive displacement pump, and more particularly to such a sensor system mounted within the positive displacement pump.

BACKGROUND

Generally, positive displacement pumps, sometimes referred to as reciprocating pumps, are used to pump fluids in a variety of well applications. For example, a reciprocating pump may be deployed to pump fluid into a wellbore and the surrounding reservoir. The reciprocating pump is powered by a rotating crankshaft which imparts reciprocating motion to the pump. This reciprocating motion is converted to a pumping action for producing the desired fluid.

A given reciprocating pump may include one or more pump chambers that each receive a reciprocating plunger. As the plunger is moved in one direction by the rotating crankshaft, fluid is drawn into the pump chamber through a one-way suction valve. Upon reversal of the plunger motion, the suction valve is closed and the fluid is forced outwardly through a discharge valve. The continued reciprocation of the plunger continues the process of drawing fluid into the pump and discharging fluid from the pump. The discharged fluid can be routed through tubing to a desired location, such as into a wellbore.

As is often the case with large systems and industrial equipment, regular monitoring and maintenance of positive displacement pumps may be sought to help ensure uptime and increase efficiency. Accordingly, a need exist for an improved monitoring system for a positive displacement pump.

SUMMARY

In one embodiment, the present invention is a positive displacement pump that includes a pump housing having a pump chamber; a plunger mounted in the pump housing for reciprocating motion in the pump chamber; a suction valve positioned to allow a fluid to enter the pump chamber upon movement of the plunger in a first direction; a discharge valve positioned to discharge the fluid from the pump chamber upon movement of the plunger in a second direction; and at least one sensor enclosed by the pump housing for measuring at least one pump condition parameter.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

As such in FIGS. 1-5 embodiments of the present invention relate to a system and methodology for providing optimal use of a positive displacement pump deployed, for example, in a well related system. In one aspect, a sensor system is located within the positive displacement pump to detect vital pump condition parameters. These parameters can be transferred to a control system at the surface of the well, which can interpret the parameters and determine the pump's condition. This control system can also predict when maintenance or part replacements are needed.

In one embodiment, the sensor system includes one or more sensors that are self powered using the pump motion, the pump vibration, or another appropriate energy source from the pump, as a power source. As used herein, a self-powered device is a device powered by a means other than a battery or an external power cord. For example, a self powering mechanism of a sensor according to the present invention may include a magnet-coil assembly or a piezoelectric material, among other appropriate self powering mechanisms.

In one embodiment described herein, the sensor system is used to obtain data on pump condition parameters that indicate abnormal events during pumping or degradation of suction valves and/or discharge valves within the pump. The determination of valve wear can be indicative of a failure mode, and the data can be used in predicting failure of the component. Examples of abnormal events that occur during pumping include pump cavitation, loss of prime, valves stuck in an open or closed position, and debris interfering with valve closure.

Figure 1:
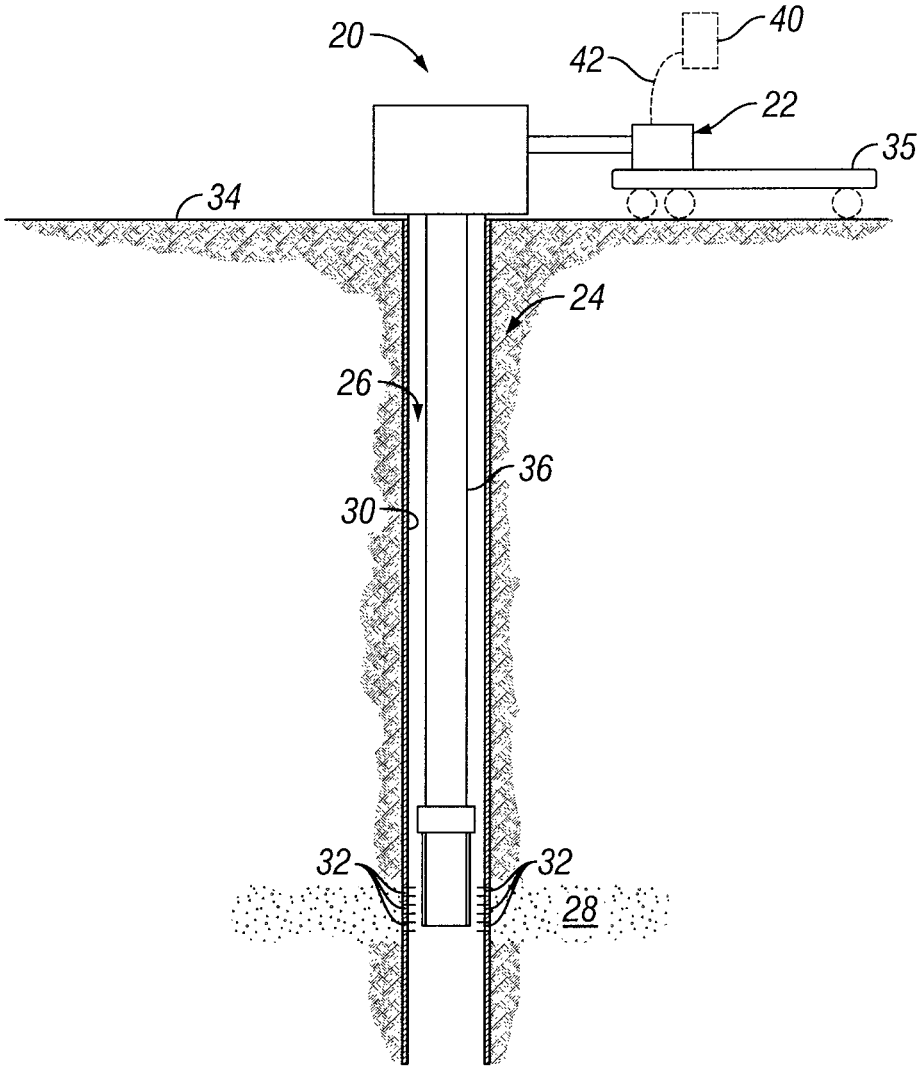
FIG. 1 is a schematic illustration of a pumping system for use in a well operation according to one embodiment of the present invention.

Referring generally to FIG. 1, a system 20 is illustrated for use in a well application, according to one embodiment of the present invention. It should be noted that the present system and method can be used in a variety of applications. As such, the illustrated well application is merely used as an example to facilitate explanation. In the illustrated embodiment, the system 20 includes, for example, a positive displacement pump, i.e. a reciprocating pump 22, deployed for pumping a fluid into a well 24 having a wellbore 26 drilled into a reservoir 28 containing desirable fluids, such as hydrocarbon based fluids.

In many applications, the wellbore 26 is lined with a wellbore casing 30 having perforations 32 through which fluids can flow between the wellbore 26 and the reservoir 28. The reciprocating pump 22 may be located at a surface location 34, such as on a truck or other vehicle 35, to pump fluid into the wellbore 26 through the tubing 36 and out into the reservoir 28 through the perforations 32. By way of example, the well application may include pumping a well stimulation fluid into the reservoir 28 during a well stimulation operation, e.g. pumping a fracturing fluid into the well.

In the embodiment illustrated in FIG. 1, the positive displacement pump 22 is coupled to a control system 40 by one or more communication lines 42. The communication line(s) 42 can be used to carry signals between the positive displacement pump 22 and the control system 40. For example, data from sensors located within the pump 22 can be output through communication lines 42 for processing by control system 40. The form of communication lines 42 may vary depending on the design of the communication system. For example, the communication system may be formed as a hardwired system in which communication lines 42 are electrical and/or fiber-optic lines.

Alternatively, the communication system may include a wireless system in which communication lines 42 are wireless and able to provide wireless communication of signals between the pump sensors and the control system 40. An advantage of the wireless communication system is that it lacks wires, which if present could be inadvertently moved and/or dislodged from a desired location due to human interaction or due to movements or vibrations caused by the mere operation of the pump.

Figure 2:
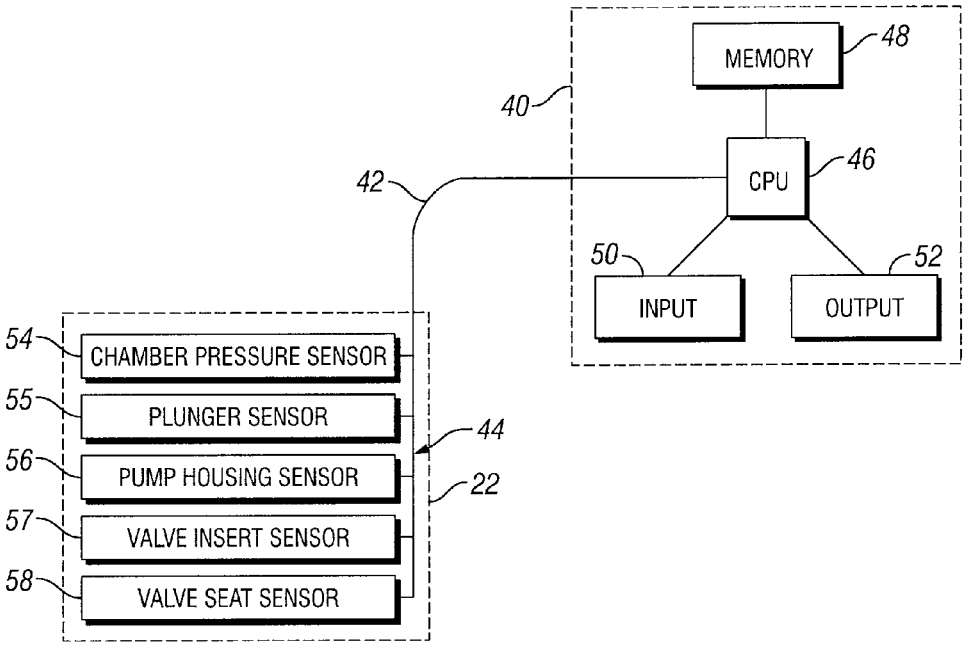
FIG. 2 is a schematic illustration of a various sensors coupled to a control system for use in the pumping system of FIG. 1.

Referring to FIG. 2, the control system 40 may be a processor based control system able to process data received from a sensor system 44 deployed within the pump 22. By way of example, the control system 40 may be a computer-based system having a central processing unit (CPU) 46. In one embodiment, the CPU 46 is operatively coupled to a memory device 48, as well as an input device 50 and an output device 52. The input device 50 may include a variety of devices, such as a keyboard, a mouse, a voice-recognition unit, a touch-screen, among other input devices, or combinations of such devices. The output device 52 may include a visual and/or audio output device, such as a monitor having a graphical user interface. Additionally, the processing may be done on a single device or multiple devices at the well location, away from the well location, or with some devices located at the well and other devices located remotely.

The sensor system 44 is designed to detect specific parameters associated with the operation of the positive displacement pump 22. Data related to the specific parameters is output by the sensor system 44 through communication line or lines 42 to the control system 40 for processing and evaluation (note again that in one embodiment this communication is wireless.) The pump parameter data is used to determine possible failure modes through indications of pump malfunctions, such as pump component degradations, e.g. pump valve or valve seat degradation.

The control system 40 also can be used to evaluate and predict an estimated time to failure using techniques, such as data regression. As will be explained more fully below, the sensor system 44 may include one or more sensors located within the positive displacement pump 22. Examples of such sensors include a pump chamber sensor 54, a plunger sensor 55, a pump housing sensor 56, a valve insert sensor 57, and a valve seat sensor 58.

Figure 3:
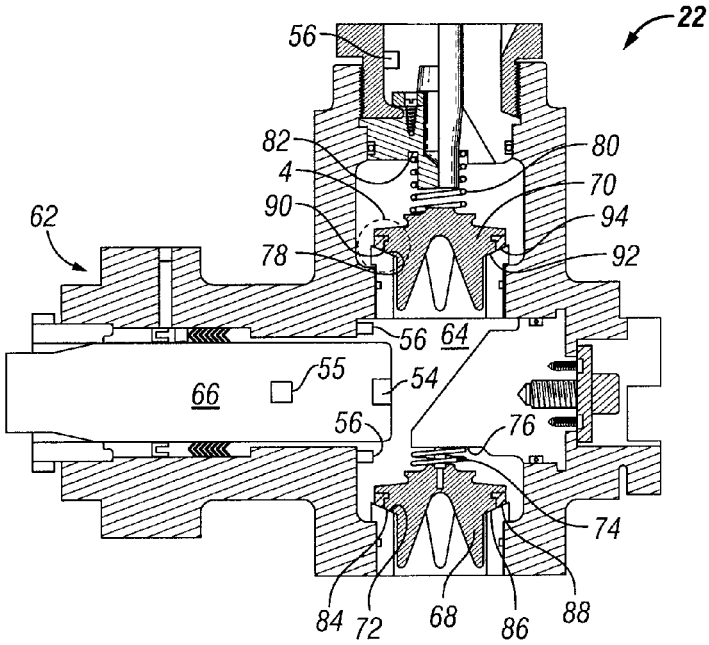
FIG. 3 is a cross-sectional view of a positive displacement pump that can be used in the system illustrated in FIG. 1, according to an embodiment of the present invention.

A positive displacement pump 22 according to one embodiment of the present invention is illustrated in FIG. 3. As illustrated, the pump 22 includes a pump housing 62 having a pump chamber 64. A plunger 66 is slidably mounted within pump housing 62 for reciprocating motion within the pump chamber 64. The reciprocating motion of the plunger 66 acts to change the volume of the pump chamber 64. The pump 22 further includes check valves, such as a suction valve 68 and a discharge valve 70, that control the flow of fluid into and out of the pump chamber 64 as the plunger 66 reciprocates.

The reciprocating motion of the plunger 66 may be generated by a rotating crankshaft (not shown), as known to those of ordinary skill in the art. It should also be noted that a single plunger and a single pump chamber are illustrated to facilitate explanation. However, the illustrated single plunger and single pump chamber also are representative of potential additional plungers and pump chambers along with their associated check valves. For example, the illustrated single plunger and single pump chamber may form a portion of a three chamber, triplex pump. With a triplex pump or other multiple chamber pumps, the motion of the plungers can be staggered to achieve a more uniform flow of pumped fluids, making such pumps desirable in a number of pumping applications.

The suction valve 68 and the discharge valve 70 are actuated by fluid and spring forces. The suction valve 68, for example, is biased toward a suction valve seat 72, i.e. toward a closed position, by a spring 74 positioned between the suction valve 68 and a spring stop 76. Similarly, the discharge valve 70 is biased toward a discharge valve seat 78, i.e. toward a closed position, by a discharge valve spring 80 positioned between the discharge valve 70 and a spring stop 82.

As shown, the suction valve 68 further includes a sealing surface 84 oriented for sealing engagement with the valve seat 72. The sealing surface 84 of the valve 68 includes a strike face 86, that may be formed of a metal, and a flexible portion that may be formed as a flexible valve insert 88. The flexible valve insert 88 may be slightly raised relative to the strike face 86.

Similarly, the discharge valve 70 includes a sealing surface 90 oriented for sealing engagement with the valve seat 78. The sealing surface 90 of the valve 70 includes a strike face 92, that may be formed of a metal, and a flexible portion that may be formed as a flexible valve insert 94. The flexible valve insert 94 may be slightly raised relative to strike face 92.

When the plunger 66 moves outwardly (to the left in FIG. 3), a drop in pressure is created within the pump chamber 64. This drop in pressure causes the suction valve 68 to move against the bias of spring 74 to an open position and causes fluid to flow into pump chamber 64 through the suction valve 68. This phase can be referred to as the "suction stroke." When the plunger 66 moves in a reverse direction (to the right in FIG. 3), the suction valve 68 is closed by the spring 74, and pressure is increased in the pump chamber 64. The increase in pressure causes the discharge valve 70 to open and forces fluid from the pump chamber 64 outwardly through discharge valve 70. The discharge valve 70 remains open while the plunger 66 continues to apply pressure to the fluid in the pump chamber 64. The high-pressure phase in which fluid is discharged through the discharge valve 70 is known as the "discharge stroke."

As each valve 68,70 is closed, its valve insert 88,94 contacts its corresponding seat 72,78 and is compressed until the strike face 86,92 of the valve 68,70 also makes contact with the seat 72,78. With the suction valve 68, for example, the valve insert 88 is compressed against the valve seat 72 until the strike face 86 contacts the valve seat 72. This normally occurs shortly after initiation of the discharge stroke. With the discharge valve 70, the valve insert 94 is compressed against the valve seat 78 until the strike face 92 contacts the valve seat 78. This normally occurs shortly after initiation of the suction stroke.

The flexible valve inserts 88,94 are beneficial for environments in which fluid containing an abrasive material, such as sand, or other particulates is pumped. Typically, the valve inserts 88,94 are composed of urethane or some other conventional deformable polymer. The deformation of the flexible valve inserts 88,94 enables the valves 68,70 to seal even when fluids containing particles, for example cement particles, sand or proppant, are moved through the pump 22. However, the abrasive action of such particulates during extended use of the valves 68,70 causes the flexible valve inserts 88,94 to degrade, which reduces the ability of the valves 68,70 to form a seal and ultimately leads to valve failure and pump malfunction. In one embodiment, the valve inserts 88,94 are made of urethane or another conventional polymers.

However, the valve inserts 88,94 may not be necessary in applications involving the pumping of relatively "clean" or "non-abrasive" fluids. In such applications, the sealing surfaces 84,90 of the valves 68,70 can be formed without the valve inserts 88,94 such that sealing is accomplished only between the metal strike face 86,92 of the valves 68,70 and the valve seats 72,78. In embodiments where the valves 68,70 are designed without the flexible valve inserts 88,94, the metal strike faces 86,92 of the valves 68,70 may still degrade with repeated use, although typically not as quickly.

As such, the sensor system 44 is incorporated into the pump 22 to detect pump condition parameters which can be used to determine component wear or degradation, and/or other pump malfunctions. In one embodiment, the sensor system 44 is used to detect wear on the suction and/or discharge valves 68,70 through the use of sensors positioned at various locations within the positive displacement pump 22.

For example, in one embodiment the sensor system 44 includes a pump chamber sensor 54 mounted on a face of the plunger 66 at a position adjacent to the pump chamber 64 to allow for continued exposure of the sensor 54 to the pump chamber 64 and the fluid disposed therein. At such a position, the sensor 54 may measure the pump chamber pressure, temperature and/or vibration, among other desired parameters. Such a sensor 54 may be self powered using energy from the motion of the plunger 66. The pump chamber sensor 54 may include any appropriate sensor, such as a pressure sensor, a temperature sensor, or an accelerometer, among other appropriate sensors.

The sensor system 44 may include a plunger sensor 55 mounted on or inside the plunger 66. At such a position, the plunger sensor 55 may measure the position of the plunger 66, among other desired parameters. Such a plunger sensor 55 may be self powered using energy from the motion of the plunger 66. The plunger sensor 55 may include any appropriate sensor, such as an accelerometer or a proximity switch, among other appropriate sensors.

The sensor system 44 may include a pump housing sensor 56 mounted on or within an interior wall of the pump housing 62. Although FIG. 3 shows two possible locations of the pump housing sensor 56, in one embodiment the pump housing sensor 56 may be mounted at any position along the interior wall of the pump housing 62 as long as it is adjacent to the pump chamber 64. The pump housing sensor 56 may measure the pump chamber pressure, temperature and/or vibration, among other desired parameters.

Note that in order to measure the pump chamber pressure, it is advantageous for the pump housing sensor 56 to be positioned such that it may contact fluid within the pump chamber 64. The pump housing sensor 56 may be self powered using stress from the energized fluid within the pump chamber 60. The pump housing sensor 56 may include any appropriate sensor, such as a pressure sensor, a temperature sensor, or an accelerometer among other appropriate sensors.

Figure 4:
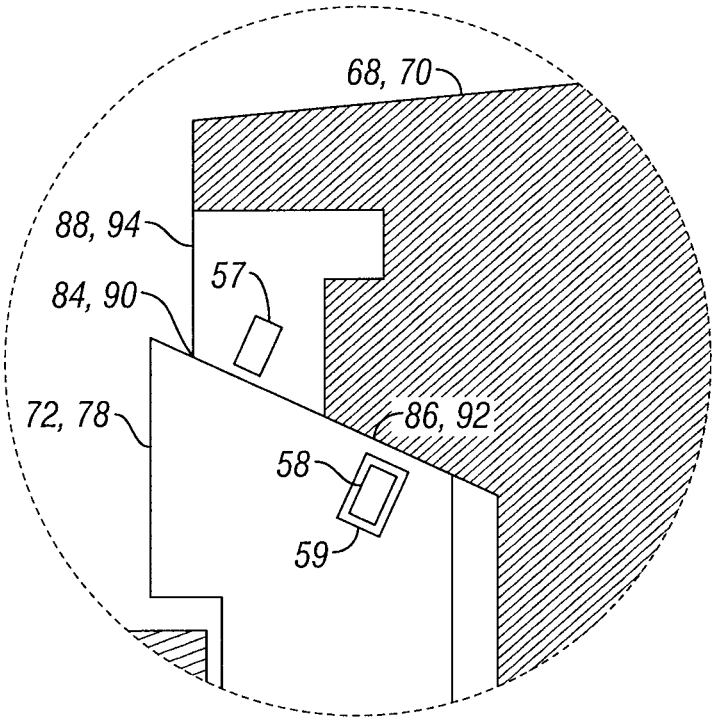
FIG. 4 is close up view taken from detail 4 of FIG. 3, showing the interaction of a valve with a valve seat.
Figure 5:
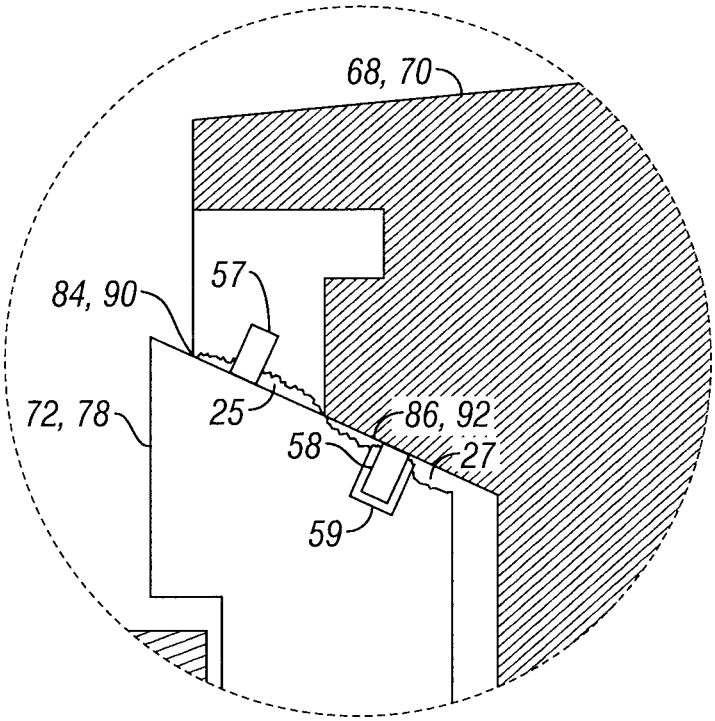
FIG. 5 is close up view of the valve and valve seat of FIG. 4 shown with degradation of both the valve and the valve seat.

As shown in FIGS. 4 and 5, the sensor system 44 may include a valve insert sensor 57 mounted on or within the flexible valve inserts 88,94 of either or both of the valves 68,70. The valve insert sensor 57 measures a degradation 25 (see FIG. 5) or a wearing away of the valve insert 88,94 to which it is attached.

Typically, the valve insert 88,94 is composed of an insulator, and the valve seat 72,78 is composed of a conductor. In such an embodiment, the valve insert sensor 57 may be a sensor that measures conductivity between itself and another conductor, such as an electrical resistivity sensor or a voltage sensor, among other appropriate sensors.

As such, in this embodiment, the valve insert sensor 57 is embedded in the valve insert 88,94 at a position such that when the valve insert 88,94 is not degraded (as shown in FIG. 4) or at least when the valve insert 88,94 is degraded to an acceptable level, the valve insert sensor 57 does not contact the valve seat 72,78 and therefore cannot measure a conductivity therebetween; and when the valve insert 88,94 is degraded to an undesirable level (as shown in FIG. 5 and indicated by degraded section 25), the valve insert sensor 57 contacts the valve seat 72,78 and measures a conductivity therebetween. At such a time, the valve insert sensor 57 may send a signal to the control system 40 indicating an undesirably worn valve insert 88,94.

Additionally or in the alternative, the valve insert sensor 57 may be configured to measure a conductivity between itself and the fluid being pumped. Such a situation occurs when the end of the sensor 57 is exposed and in contact with the fluid being pumped, but not yet exposed to the extend allowing the sensor 57 to contact the valve seat 72,78.

In another embodiment, the valve insert sensor 57 measures the integrity of itself. When the integrity is damaged to a predetermined condition, then the control system 40 determines that the valve insert 88,94 is undesirably worn. In either embodiment, the valve insert sensor 57 can be self powered by the stress from the valve insert 88,94 deformation.

As is also shown in FIGS. 4 and 5, the sensor system 44 may include a valve seat sensor 58 mounted on or within the valves seat 72,78. The valve seat sensor 58 measures a degradation 27 (see FIG. 5) or a wearing away of the valve seat 72,78 to which it is attached.

Typically, the valve seat 72,78 is composed of a conductor, and the strike face 86,92 of the valve 68,70 is composed of a conductor. In such an embodiment, the valve seat sensor 58 may be a sensor that measures conductivity between itself and another conductor, such as an electrical resistivity sensor or a voltage sensor, among other appropriate sensors.

As such, in this embodiment, the valve seat sensor 58 is encased, at least partially, in an insulator 59; and the sensor 58 and the insulator 59 are embedded in the valve seat 72,78 at a position such that when the valve seat 72,78 is not degraded (as shown in FIG. 4) or at least when the valve seat 72,78 is degraded to an acceptable level, the valve seat sensor 58 does not contact the strike face 86,92 of the valve 68,70 and therefore cannot measure a conductivity therebetween; and when the valve seat 72,78 is degraded to an undesirable level (as shown in FIG. 5 and indicated by degraded section 27), which is quickly followed by a degradation of the insulator 59, the valve seat sensor 58 contacts the valve seat 72,78 and measures a conductivity therebetween. At such time, the valve seat sensor 58 may send a signal to the control system 40 indicating an undesirably worn valve seat 72,78.

Additionally or in the alternative, the valve seat sensor 58 may be configured to measure a conductivity between itself and the fluid being pumped. Such a situation occurs when the end of the sensor 58 is exposed and in contact with the fluid being pumped, but not yet exposed to the extend allowing the sensor 58 to contact the strike face 86,92 of the valve 68,70.

In another embodiment, the valve seat sensor 58 measures the integrity of itself. When the integrity is damaged to a predetermined condition, then the control system 40 determines that the valve insert 88,94 is undesirably worn. In either embodiment, the valve seat sensor 58 can be self powered by the stress from the valve seat 72,78 deformation, or the valve seat sensor 58 can be battery powered and operated in a low-bandwidth mode.

Any one or all of the sensors 54-58 may be mounted within the pump housing 62 (FIG. 3 shows each of the sensors 54-58 mounted within the pump housing 62) to protect the sensors 54-58 from the environment external to the pump housing 62 and to protect the sensors 54-58 from inadvertent movement or dislodgement of the sensors 54-58, such as by inadvertent human contact.

As eluded to above, any one or all of the sensors 54-58 may communicate with the control system 40 wirelessly. Wireless communication between the sensors 54-58 and the control system 40 lessens the likelihood of the sensors 54-58 being inadvertently moved and/or dislodged from a desired location due to inadvertently human contact or due to movements or vibrations caused by the mere operation of the pump 22.

As described above, a plurality of pump parameters detected within a positive displacement pump can be used individually or in combination to determine indications of pump component degradation. It should be noted that different types of sensors can be used in pump 22, and those sensors can be located at a variety of locations within the pump depending on, for example, pump design, well environment and sensor capability. Additionally, the sensor or sensors may be deployed in pumps having a single pump chamber or in pumps having a plurality of pump chambers to provide data for determining degradation of valves associated with each pump chamber and/or other pump malfunctions. Note that the sensors 54-58 are shown schematically in FIGS. 1-5 and are not necessarily drawn to scale.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

What is claimed is:

1. A positive displacement pump for pumping fluid into a well, comprising:

a pump housing having a pump chamber;

a plunger mounted in the pump housing for reciprocating motion in the pump chamber;

a suction valve positioned to allow the fluid to enter the pump chamber upon movement of the plunger in a first direction, wherein the suction valve is movable into and out of contact with a suction valve seat;

a discharge valve positioned to discharge the fluid from the pump chamber upon movement of the plunger in a second direction, wherein the discharge valve is movable into and out of contact with a discharge valve seat wherein one of the suction valve and the discharge valve comprises a flexible valve insert having a valve insert sensor embedded within that measures a degradation of the valve insert;

a self-powered sensor located within the pump housing for measuring at least one pump condition operation parameter during an operation of the pump, wherein the self-powered sensor is powered by stress from the fluid within the pump chamber energized from the motion of the plunger and wherein the at least one pump condition operation parameter comprises degradation of one of the suction valve seat and the discharge valve seat; and a control system in communication with the self-powered sensor or valve insert sensor or both sensors to process the at least one pump condition operation parameter measured by the self-powered sensor or valve insert sensor or both sensor for evaluating a condition of the pump.

2. The pump of claim 1, wherein the communication between the control system and the self-powered sensor or valve insert sensor or both sensors is wireless.

3. The pump of claim 1, wherein the self-powered sensor or valve insert sensor or both sensors is one of a magnet-coil assembly and a piezoelectric material.

4. The pump of claim 1, wherein the self-powered sensor comprises a chamber sensor mounted at a position adjacent to the pump chamber.

5. The pump of claim 4, wherein the chamber sensor measures at least one of pressure, temperature and vibration.

6. The pump of claim 1, wherein the self-powered sensor comprises a pump housing sensor carried by an interior wall of the pump housing at a position adjacent to the pump chamber.

7. The pump of claim 6, wherein the pump housing sensor measures at least one of pressure, temperature and vibration.

8. The pump of claim 1, wherein the valve insert sensor measures a conductivity between itself and the valve seat.

9. The pump of claim 1, wherein the valve insert sensor measures an integrity of itself.

10. A positive displacement pump for pumping fluid into a well, comprising:

a pump housing having a pump chamber;

a plunger mounted in the pump housing for reciprocating motion in the pump chamber;

a suction valve positioned to allow the fluid to enter the pump chamber upon movement of the plunger in a first direction, wherein the suction valve is movable into and out of contact with a suction valve seat;

a discharge valve positioned to discharge the fluid from the pump chamber upon movement of the plunger in a second direction, wherein the discharge valve is movable into and out of contact with a discharge valve seat wherein one of the suction valve and the discharge valve comprises a flexible valve insert having a valve insert sensor embedded within that measures a degradation of the valve insert;

a self-powered sensor located within the pump housing for measuring at least one pump condition operation parameter during an operation of the pump, wherein the self-powered sensor is powered by stress from the fluid within the pump chamber energized from the motion of the plunger and wherein the at least one pump condition operation parameter comprises a degradation of one of the suction valve seat and the discharge valve seat; and a control system in wireless communication with the self-powered sensor to process the at least one pump condition operation parameter measured by the self-powered sensor for evaluating a condition of the pump, wherein the control system is also in wireless communication with the valve insert sensor.

11. The pump of claim 10, wherein the self-powered sensor comprises a chamber pressure sensor mounted on a face of the plunger at a position adjacent to the pump chamber to measure at least one of pressure, temperature and vibration.

12. The pump of claim 10, wherein the self-powered sensor comprises a plunger sensor carried by the plunger to measure a position of the plunger.

13. The pump of claim 10, wherein the self-powered sensor comprises a pump housing sensor carried by an interior wall of the pump housing at a position adjacent to the pump chamber to measure at least one of pressure, temperature and vibration.

* * * * *